US006073664A

United States Patent [19]

Angarola

[11] Patent Number: 6,073,664

[45] Date of Patent: Jun. 13, 2000

[54] STRAP TENSIONING TOOL

[75] Inventor: Barry R. Angarola, Schaumburg, Ill.

[73] Assignee: Illinois Tool Works Inc., Glenview, Ill.

[21] Appl. No.: 09/250,474

[22] Filed: Feb. 13, 1999

[51] Int. Cl.[7] ..... B21F 9/00

[52] U.S. Cl. ..... 140/123.5; 140/93.2

[58] Field of Search ..... 140/93 R, 93.2, 140/93.4, 123.5, 123.6; 24/507, 521, DIG. 22

[56] References Cited

U.S. PATENT DOCUMENTS

| | | | |
|---|---|---|---|
| 1,600,833 | 9/1926 | McChesney | 140/93.2 |
| 3,028,885 | 4/1962 | Leslie et al. . | |
| 3,048,204 | 8/1962 | Lingle . | |
| 3,249,131 | 5/1966 | Lingle . | |

OTHER PUBLICATIONS

ITW Signode, "Operation, Parts & Safety Manual, PN–114 & PRN–114 Air Powered Tensioners" Dec. 1997, pp. 1–20.

*Primary Examiner*—Lowell A. Larson
*Attorney, Agent, or Firm*—Donald J. Breh

[57] ABSTRACT

A strap tensioning tool having a gear housing with a foot pivotally coupled thereto by a rotatably supported foot pivot member, a nose pivotally coupled to the foot by a rotatably supported nose pivot member, and a foot roller rotatably coupled to the foot by a rotatably supported roller pivot member. The foot and nose are pivotally biased by corresponding compression springs that are substantially enclosed and protected from the environment. The nose has a strap engagment portion biased toward a strap support portion of the foot and is separated therefrom by a gap to facilitate insertion of a strap portion therebetween.

19 Claims, 2 Drawing Sheets

STRAP TENSIONING TOOL

BACKGROUND OF THE INVENTION

The invention relates generally to improvements in strap tensioners, particularly hand held, power strap tensioning tools.

It is known generally to tension strap applied about a load with a power or manually operated hand held tensioning tool. The tensioning tools comprise generally a gear housing with a feed wheel protruding from a side portion thereof for engaging and tensioning strap disposed between the feed wheel and a foot of the tool.

In some tensioning tools, the foot is pivotally coupled to the gear housing and a torsional foot spring biases the pivotal foot toward the feed wheel to engage the strap during tensioning. The PN-114 & PNR-114 push type tensioning tools available from ITW Signode, Glenview, Ill. for example have a breaker foot pivotally biased toward a feed wheel by a torsional foot spring to engage a strap portion between the feed wheel and an anti-friction device mounted in the foot during tensioning. See also, U.S. Pat. No. 3,249,131 entitled "Power Strap Tensioning Tool".

Some tensioning tools other than push type tools also comprise a foot biased by a torsional foot spring toward a feed wheel during strap tensioning. These tools include, among others, strap on strap tensioning tools. In strap on strap tensioning tools, however, gripper teeth are mounted in the foot, instead of the plug or roller used in push type tools, for engaging a lower strap portion during tensioning.

The torsional foot spring in the tensioning tool of U.S. Pat. No. 3,249,131 and other tools is disposed generally about a machined pivot shaft in a recess between the foot and the gear housing where the torsional foot spring is largely exposed on an upper portion of the tool. The exposed torsional foot spring however is particularly vulnerable to damage, for example from rough handling of the tool, which is common in the industry. The exposed spring also accumulates debris and particulate matter, which tends to interfere with the smooth pivoting action of the tool.

The torsional foot springs in known tensioning tools have a relatively short life span, and thus require frequent replacement. In some tools, the torsional foot spring degrades noticeably after approximately 1000 operation cycles. The short life span results partly from the relative inefficiency of torsional springs generally, and from the limitation on the number of turns or coils that will fit in the limited space between the gear housing and the pivotal foot of the tool. Also, many torsional foot springs are specialty parts, which are relatively costly.

Push type tensioning tools, for example the tools discussed in U.S. Pat. No. 3,249,131 entitled "Power Strap Tensioning Tool", also comprise a breaker nose pivotally coupled to and biased toward a breaker foot by a nose torsional spring. The breaker nose engages a metal clip disposed about overlapping strap portions during tensioning, and is pivotal to accommodate straps having different thicknesses between the breaker nose and the foot. The torsional nose spring, however, is subject to the same disadvantages discussed above in connection with the torsional foot spring.

In the tensioning tools discussed above, the foot pivots about a machined pivot shaft coupled to the gear housing. In push type tensioning tools, the breaker nose and the roller mounted in the foot also pivot about machined pivot shafts. The machined pivot shafts are rotationally fixed, often by a roll pin or by screw thread engagement with some fixed structure. The fixed pivot shafts are however difficult to assemble and maintain, and tend to wear relatively quickly. Also, many prior art pivot shafts are specialty parts having different diameters machined along the axial dimension thereof, and are thus relatively costly.

In known prior art push type tensioning tools, the gear housing has at least two access openings at least one of which has an exposed cover plate for assembly and maintenance. In the past, the multiple access openings were necessary to install components in the gear housing, including for example a drive gear and shaft coupled to the feed wheel and bearings associated therewith. In the tool of U.S. Pat. No. 3,249,131, for example, two oversized radial and thrust load bearings are installed in the gear housing from an opening on a side portion thereof and a worm wheel is installed from an opening on the bottom portion thereof. During use, however, fasteners that retain the exposed cover plate on the tool tend to loosen, resulting in separation of the cover plate therefrom. It is not uncommon for the tools to be operated without a cover plate, exposing the gear housing interior to the environment.

The present invention is drawn toward advancements in the art of strap tensioning tools.

An object of the invention is to provide novel strap tensioning tools that overcome problems in the art.

Another object of the invention is to provide novel strap tensioning tools that are economical.

Another object of the invention is to provide novel strap tensioning tools that are more reliable, have fewer components, and are easier to operate, assemble and maintain.

A further object of the invention is to provide novel strap tensioning tools having improved pivotal foot assemblies.

Another object of the invention is to provide novel strap tensioning tools having a gear housing with only a single access opening and corresponding cover plate.

Another object of the invention is to provide novel strap tensioning tools having a foot pivotally coupled to a gear housing and biased by a compression foot spring toward a feed wheel protruding from the gear housing.

Another object of the invention is to provide novel strap tensioning tools having a nose pivotally coupled to a foot and biased by a compression nose spring toward a strap support portion of the foot.

A further object of the invention is to provide novel strap tensioning tools having one or more of a gear housing with a foot pivotally coupled thereto by a rotatably supported foot pivot member, a nose pivotally coupled to the foot by a rotatably supported nose pivot member, and a foot roller rotatably coupled to the foot by a rotatably supported roller pivot member, and combinations thereof.

Yet another object of the invention is to provide novel strap tensioning tools having a foot coupled to a gear housing, and a nose pivotally coupled to and biased toward the foot. The nose having a strap engagment portion biased toward a strap support portion of the foot and separated therefrom by a gap to facilitate insertion of a strap portion therebetween.

Another object of the invention is to provide novel strap tensioning tools having a foot pivotally biased relative to a gear housing by a foot biasing member, preferably a compression spring, that is protected from the environment.

Still another object of the invention is to provide novel strap tensioning tools having a foot pivotally coupled to a gear housing, and a lever extending from the foot and aligned substantially along an axis of the gear housing.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
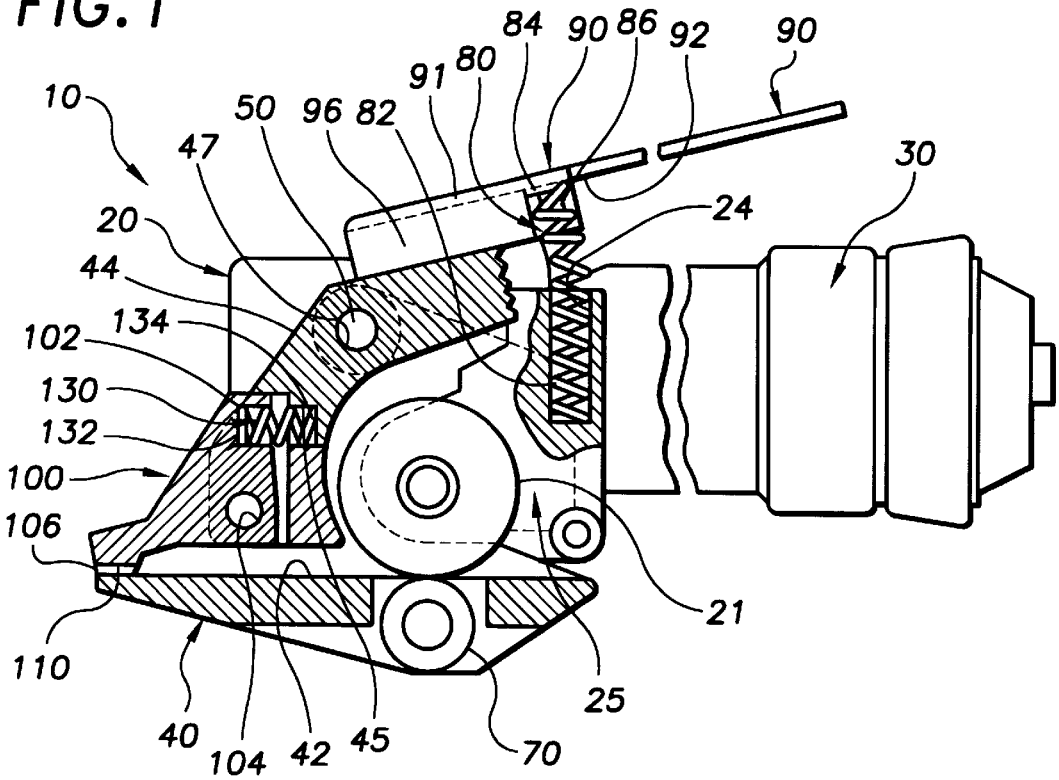
FIG. 1 is a partial sectional side view of a tensioning tool with improvements of the present invention.

FIG. 1 is a strap tensioning tool 10 comprising generally a gear housing 20 having a feed wheel 21 protruding from a portion thereof. The gear housing 20 is coupled generally to a drive housing 30 for accommodating an air motor or some other drive means that drives the feed wheel 21. Other embodiments do not include a drive housing, and instead have a manually operated feed wheel, as is known generally.

The tensioning tool 10 in the exemplary embodiment is an air powered push type tensioning tool, but many aspects of the present invention are applicable more generally to other types of strap tensioning tools, for example strap on strap tensioning tools among other powered and manually operated tools.

Many strap tensioning tools, including the exemplary push tensioning tool and strap on strap tensioning tools, comprise a foot 40 pivotally coupled to the gear housing 20. In the exemplary embodiment, illustrated best in FIGS. 1 and 2, the foot 40 comprises generally a strap support portion 42 disposed generally opposite the feed wheel 21, and a bracket 44 extending upwardly from an inner portion 41 of the strap support portion 42 thereof, illustrated also in FIG. 4.

The foot 40 is pivotally coupled to the gear housing 20, and is generally biased relative thereto as discussed further below, to support a single strap or overlapping strap portions on the strap support portion 42 thereof adjacent the feed wheel 21 during strap tensioning. In push tensioning tools, the foot 40 is often referred to a breaker foot, since a portion thereof facilitates breaking a strap portion adjacent a sealed fastening clip, not illustrated, after tensioning and sealing.

Figure 2:
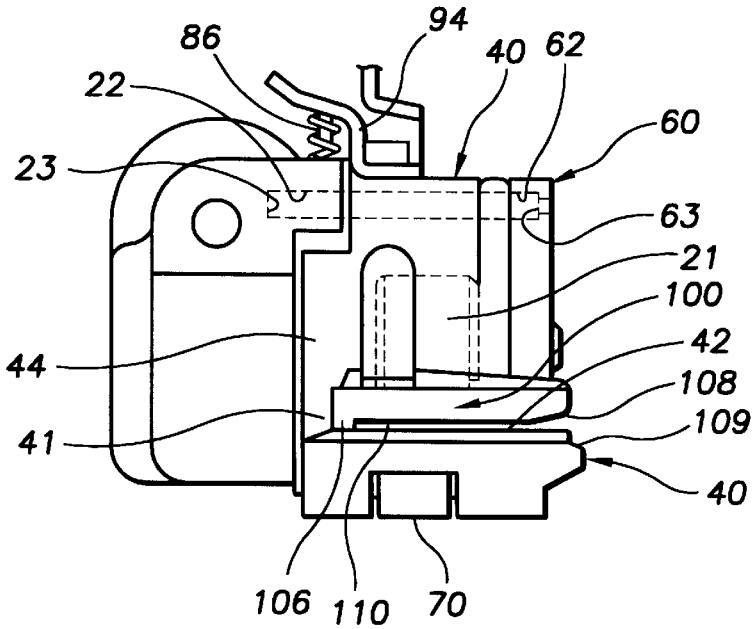
FIG. 2 is a partial front view of the tool of FIG. 1.

The foot is pivotally coupled to the gear housing, for example by a non-rotatable machined pivot shaft as is known, or preferably by a rotatable foot pivot member 50. FIGS. 1 and 2 illustrate generally the foot 40 disposed between the gear housing 20 and a side plate 60 of the tool 10. The side plate 60 is fastened to the gear housing 20 by means known generally but not illustrated, for example machine screws.

Figure 3:
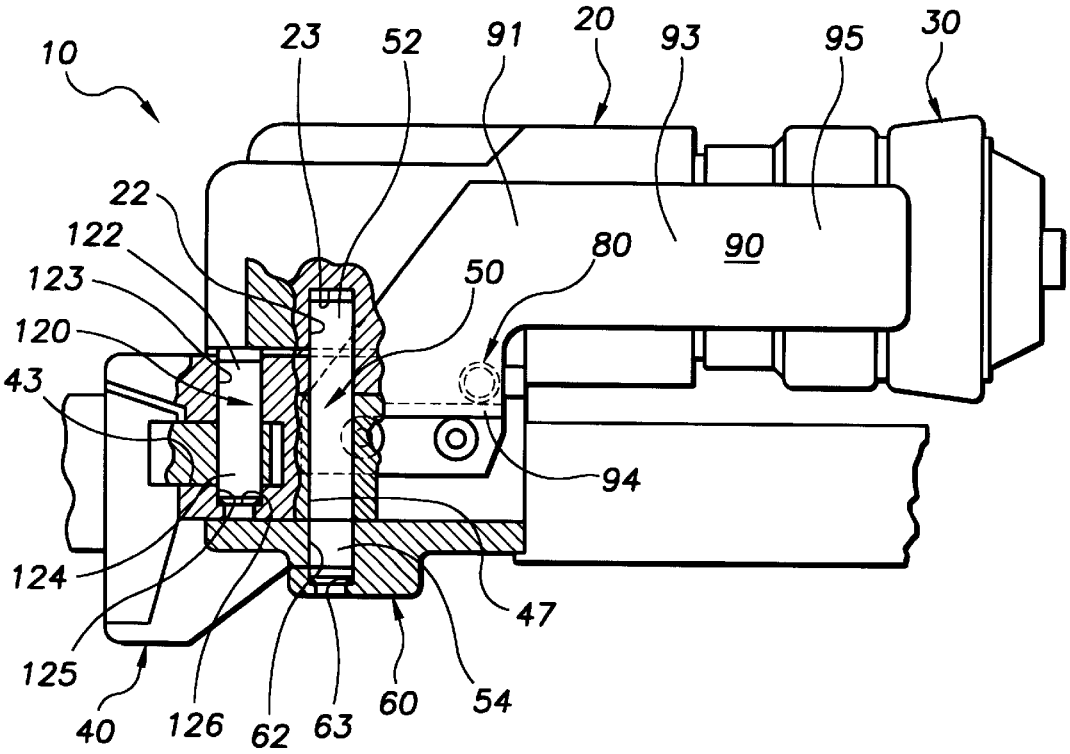
FIG. 3 is a partial top view of the tool of FIG. 1.

In one preferred embodiment, illustrated in FIGS. 1 and 3, the foot pivot member 50 is disposed through an opening 47 of the bracket 44 to pivotally couple the foot 40 to the gear housing 20. FIG. 3 illustrates the foot pivot member 50 having first and second end portions 52 and 54, each of which are rotatably supported by a corresponding one of the gear housing 20 and the side plate 60. FIG. 3 illustrates, more particularly, the gear housing 20 having a first pivot recess 22 for rotatably supporting the end portion 52 of the foot pivot member 50, and the side plate 60 having a first pivot recess 62 for rotatably supporting other end portion 54 of the foot pivot member 50. The foot pivot member 50 is free to rotate relative to the gear housing 20, the foot 40, and the side plate 60, thereby reducing wear, and providing improved pivoting action and reliability of the tool.

The foot pivot member 50 is retained generally axially between the gear housing 20 and the side plate 60 when the side plate is fastened to the gear housing by means discussed above. FIGS. 2 and 3 illustrate more particularly the gear housing recess 22 have an end portion 23 and the side plate recess 62 having an end portion 63 between which the foot pivot member is retained, thereby simplifying assembly and eliminating the requirement for roll pins or other fastening means used in the prior art. The foot pivot member 50 is preferably a standard, fixed diameter metal pin, or dowel, which is available commercially, thereby eliminating the need for specialty machining different diameters as is required in the prior art.

Push tensioning tools generally include an anti-friction member disposed on the strap support portion 42 of the foot 40 generally opposite the feed wheel 21. In the exemplary push type tensioning tool 10 of FIGS. 1, 2 and 4, the anti-friction member is a roller 70 rotatably coupled to the foot, and more particularly to the strap support portion 42 thereof. Other push type tensioning tools include alternatively a fixed plug disposed in the strap support portion of the foot, over which the strap frictionally slides during tensioning by the feed wheel 21. In strap on strap tensioning tools, however, gripper teeth are mounted in the foot, instead of the plug or roller in push type tools, for frictionally engaging a lower strap portion during tensioning.

Figure 4:
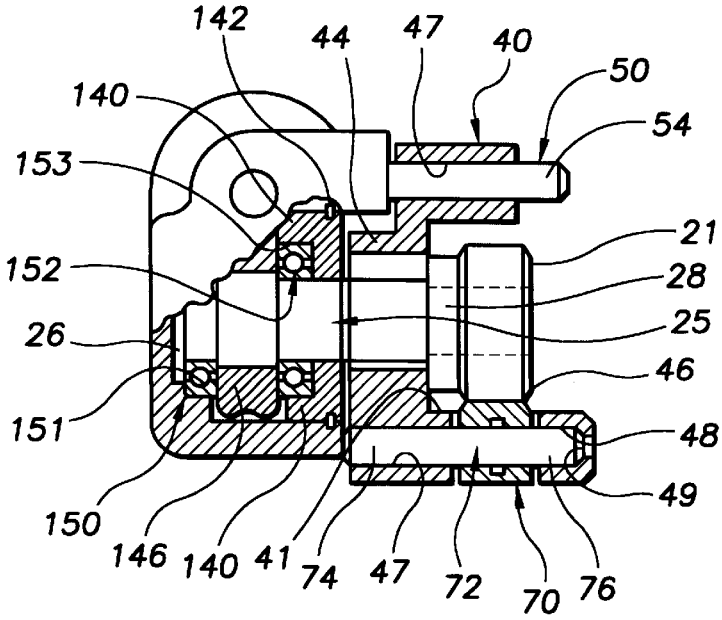
FIG. 4 is a partial sectional view of the tool of FIG. 1.

The roller 70 is pivotally coupled to the foot 40, for example by a non-rotatable machined pivot shaft as is known, or preferably by a rotatable roller pivot member 72, which is similar to the foot pivot member 50 discussed above. FIG. 4 illustrates generally the roller 70 disposed in a roller recess 46 of the foot 40. The roller pivot member 72 is disposed rotationally or non-rotationally through an opening of the roller 70. The roller pivot member 72 also has first and second end portions 74 and 76, each of which are rotatably supported by corresponding portions of the foot, and more particularly in corresponding first and second roller pivot recesses 47 and 48 thereof. The roller pivot member 72 is thus free to rotate relative to the gear housing 20, the foot 40, and the roller 70 depending on whether it is fastened to the roller, thereby reducing wear, and providing improved operation and reliability.

The roller pivot member 72 is also retained axially between the gear housing 20 and the foot 40 when the foot is pivotally coupled to the gear housing as discussed above. FIG. 4 illustrates more particularly the first roller pivot recess 47 as an opening through the foot to the roller recess 46 through which the roller pivot member 72 may be inserted during assembly of the roller 70. The second roller pivot recess 48 has an end portion 49 which axially retains the second end portion 76 of the roller pivot member 72 therein. The other end portion 74 of the roller pivot member 72 is axially retained by the gear housing 20 when the foot 40 is assembled therewith, thereby simplifying assembly and eliminating the requirement for roll pins or other fastening means used in the prior art. The roller pivot member 72 is made preferably from the same material as is the foot pivot member 50 discussed above.

In FIGS. 1 and 3, the foot 40 includes a lever 90 comprising generally a first end portion 91 coupled to and extending from the bracket 44 on an upper portion of the tool. The handle 90 is actuatable toward and away from the gear housing 20 to pivot the foot 40 against the pivotal bias of the compression foot spring 80 to move the strap support portion 42 of the foot away from the feed wheel 21. FIG. 3 illustrates an intermediate portion 93 and a second end portion 95 of the lever extending away from the foot 40 and disposed generally along an axial dimension of the gear housing 20, thereby providing a more comfortable lever gripping surface and reducing the width profile of the tool. In the exemplary embodiment, the drive housing 30 coupled to the gear housing also comprises an axial dimension that is aligned substantially with the axial dimension of the gear housing 20. The intermediate portion 93 and second end portion 95 of the handle 90 extending from the foot are also disposed generally along the axial dimension of the drive housing 30.

FIG. 1 illustrates a compression foot spring 80 protruding from the gear housing 20 and acting on the foot 40 to pivotally bias the foot in a manner that positions the strap support portion 42 thereof toward the feed wheel 21. A first end portion 82 of the compression foot spring 80 is disposed in a housing recess 24, and a second end portion 84 of the compression foot spring engages a portion of the foot. The second end portion 84 of the compression foot spring 80 is engaged more particularly with a spring engagement portion of the bracket 44 spaced apart from the foot pivot member, so that a portion of the strap support portion disposed between the foot pivot member 50 and the spring engagement portion of the bracket, which is the roller 70 in the exemplary embodiment, is biased toward the feed wheel 21.

In FIG. 1, the housing recess 24 is on an upper side portion of the gear housing so that the second end portion 84 of the compression foot spring 80 protrudes upwardly therefrom. In the exemplary embodiment, the spring engagement portion of the bracket 44 is at least partially enclosed to protect the compression foot spring 80. The second end portion 84 of the foot spring 80 preferably engages a substantially enclosed underside portion 92 of the lever 90, which includes a protuberance 86 extending therefrom axially into the compression foot spring to prevent slippage of the compression foot spring 80. The enclosed underside portion 92 of the lever 90 covers the compression foot spring 80 so that it is not exposed at least on the upper portion of the tool, where it is most vulnerable. A flange 94 extending downwardly from the lever 90 covers and protects one side portion of the foot spring 80 protruding from the housing recess 24. An opposing side portion of the foot spring 80 is protected by the gear housing 20 and the handle 90. Thus the compression foot spring 80 is substantially covered and protected, especially on the upper and side portions of the tool, thereby lessening the possibility of damage to the spring.

The compression foot spring 80 of the present invention is more efficient, reliable and longer lived than the torsional springs of prior art tensioning tools. Also, the compression foot spring 80 is not disposed about the foot pivot member between the gear housing 20 and the foot 40, as is the torsional foot spring in prior tensioning tools. The compression foot spring 80 of the present invention may thus be replaced or changed relatively easily without substantial disassembly of the tool, and more particularly by merely removing a lever handle thereof. The compression foot spring 80 of the present invention is preferably a standard part and is therefore much more economical than the non-standard specialty torsional foot springs of prior art tensioning tools.

In FIGS. 1 and 3 of the present invention, the tool 10 has generally reduced size, is relatively narrow, and has reduced weight in comparison to those of the prior art. The foot 40 is also positioned more closely to the gear housing 20, made possible partly by the elimination of the prior art foot torsion spring therebetween. The reduced size and weight and protrusion of the foot 40 in the present invention reduces the torque applied by the foot 40 about an axis of the gear housing 20. In prior art tensioning tools, this torque is substantial due to the size of the foot and the extent to which it protrudes from the gear housing, partly for accommodating the prior art torsional foot spring therebetween. The reduced torque in the tool 10 of the present invention lessens the tendency of the tool to twist out of the hand of a tool operator, thereby reducing the physical fatigue associated with the use of the tool.

In push type tensioning tools, illustrated in FIG. 1, a breaker nose 100 having a strap engagement portion 110 is pivotally coupled to the foot 40, and more particularly in a nose recess 43 thereof. The breaker nose, or nose, 100 is pivotally coupled to the foot, for example by a non-rotatable machined pivot shaft as is known, or preferably by a rotatable nose pivot member 120, which is similar to the foot and roller pivot members discussed above. FIG. 1 illustrates an opening 104 through the nose 100 for accommodating the nose pivot member. The nose pivot member 120 has first and second end portions 122 and 124, each of which are rotatably supported by corresponding portions of the foot, and more particularly in corresponding first and second nose pivot recesses 123 and 125 thereof. The nose pivot member 120 is thus free to rotate relative to the foot and the nose thereby reducing wear and providing improved operation and reliability.

The nose pivot member 120 is retained axially between the gear housing 20 and the foot 40 when the foot 40 is pivotally coupled to the gear housing 20 as discussed above. FIG. 3 illustrates more particularly the first nose pivot recess 123 as an opening through the foot to the nose recess 43 through which the nose pivot member 120 may be inserted during assembly of the nose 100. The second nose pivot recess 125 has an end portion 126 which axially retains the second end portion 124 of the nose pivot member 120 therein. The other end portion 122 of the nose pivot member 120 is axially retained by the gear housing 20 when the foot 40 is assembled therewith, thereby eliminating the requirement for roll pins or other fastening means used in the prior art. The nose pivot member 120 is made preferably from the same material as is the foot and roller pivot members discussed above, and is a standard, commercially available dowel pin having relatively low cost.

In FIG. 1, the breaker nose 100 also comprises a nose recess 102 disposed generally opposite a foot recess 45 of the foot 40. A compression nose spring 130 having a first end portion 132 disposed in the nose recess 102 and a second end portion 134 disposed in the foot recess 45 pivotally biases the breaker nose 100 so that the strap engagement portion 110 thereof is positioned toward the strap support portion 42 of the foot 40. The nose recess 102 and the foot recess 45 between which the compression nose spring 130 is disposed preferably forms an entirely enclosed cavity to protect the compression nose spring 130 from the environment and damage. Additionally, the compression nose spring 130 has many of the same advantages over the prior art as discussed above in connection with the compression foot spring 80.

In FIGS. 1 and 2, a spacer member is disposed between the breaker nose 100 and the strap support portion 42 of the foot 40 to provide a gap therebetween when the nose is biased toward the foot by a biasing member, which may be a torsional spring or a compression spring, as discussed above. The gap facilitates insertion of a strap portion between the breaker nose 100 and the strap support portion 42 of the foot 40. In FIG. 2, the spacer member is preferably a protuberance 106 extending from the breaker nose 100, although it may extend alternatively from the strap support portion 42 of the foot, whereby the compression foot spring 130 biases the protuberance 106 into engagement with the strap support portion 42 to form the gap therebetween.

FIG. 2 also illustrates the strap engagement portion 110 of the breaker nose extending at least partially across the strap support portion 42 of the foot between inner and outer portions of the breaker nose 100. The protuberance 106 extends from the inner portion of the breaker nose proximate the gear housing 20 toward the foot 40. The gap between the strap engagement portion 110 of the breaker nose 100 and the strap support portion 42 of the foot 40 preferably has a tapered strap lead-in portion decreasing from the outer portion of the breaker foot toward the inner portion thereof in the direction of the gear housing 20. In FIG. 2, the breaker nose 110 has a tapered portion 108 thereon, and the foot also has a tapered portion 109, but in other embodiments the tapered portion may be on only one or the other of the nose or foot. The tapered strap lead-in portion facilitates the initial insertion of a strap portion into the gap between the breaker nose and foot.

In FIG. 4, the gear housing 20 of the exemplary push type strap tensioning tool 10 comprises only a single access opening 25, illustrated partially in phantom in FIG. 1, to an interior portion 26 thereof. The single access opening 25 is located on a side portion of the gear housing, and the feed wheel protrudes therefrom. Illustrated best in FIG. 4, a cover plate 140 is disposed in the access opening 25, and is retained therein by a retainer ring 142. An inner side of the pivotal foot 40 is disposed adjacent the cover plate 140, and the side plate 60 is fastened to the gear housing on an outer side of the foot 40 opposite the cover plate 140, whereby the foot is pivotally coupled to the gear housing 20 and the side plate 60, as discussed above. The single access opening 25 of the gear housing 20 eliminates the requirement for any exposed cover plates that may tend to loosen and fall off the tool as in the prior art.

FIG. 4 also illustrates the feed wheel 21 coupled to a drive shaft 28 protruding from the access opening 25, and more particularly through a drive shaft opening of the cover plate 140. A sealing member, not illustrated, may be disposed between the drive shaft 28 and the cover plate 140 as is known generally. A worm wheel 146, driven by a worm gear, is rotatably disposed in the gear housing 20 and coupled to the drive shaft 28 extending therefrom. The drive shaft 28 is rotatably supported on first and second end portions thereof by correspond first and second bearings 150 and 152 disposed in the gear housing on inner and outer sides of the worm wheel 146.

The first bearing 150 is press fit or otherwise disposed in a bearing recess 151 formed in the gear housing 20, and the second bearing 152 is disposed in a bearing recess 153 of the cover plate 140. Supporting the second bearing 152 by the cover plate 140, rather than by a protruding portion of the housing as in prior art tools, permits assembly of the first and second bearings 150 and 152 and the worm wheel 146 into the gear housing interior through the same access opening 25 on the side of the tool. Thus, in the present invention a separate access opening is not required for assembly of the worm wheel as in prior art tools, and the gear housing requires only a single access opening.

The first bearing 150 is preferably a combined radial and thrust load bearing having a first diameter, and the second bearing 152 is preferably a radial load bearing having a second diameter less than the first diameter of the first bearing. The second bearing is reduced in size relative to the first bearing by using a bearing suitable for radial loads only. The reduced size of the first and particularly the second bearing of the present invention also reduces the size and weight of the gear housing.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A strap tensioning tool comprising:

a gear housing having a feed wheel protruding from a portion thereof, the gear housing having a housing recess;

a foot pivotally coupled to the gear housing and having a strap support portion disposed generally opposite the feed wheel;

a compression foot spring having a first end portion disposed in the housing recess, the compression foot spring having a second end portion protruding from the housing recess and engaged with the foot, the compression foot spring pivotally biases the strap support portion of the foot toward the feed wheel.

2. The tool of claim 1, the foot comprises a bracket extending upwardly from an inner portion of the strap support portion, a foot pivot member disposed through the bracket and supported by the gear housing pivotally couples the foot to the gear housing, the second end portion of the compression foot spring is engaged with a spring engagement portion of the bracket spaced apart from the foot pivot member, a portion of the strap support portion is disposed between the foot pivot member and the spring engagement portion of the bracket.

3. The tool of claim 1, the foot comprises a bracket extending upwardly from an inner portion of the strap support portion, the bracket is pivotally coupled to the gear housing, the second end portion of the compression foot spring is engaged with a substantially enclosed portion of the bracket on an upper portion of the tool to protect the compression foot spring.

4. The tool of claim 3, the housing recess is on an upper side portion of the gear housing so that the second end portion of the compression foot spring protrudes from the upper side portion of the gear housing, the foot has a lever extending from the bracket and over an upper portion of the tool, the second end portion of the compression foot spring engages a partially enclosed underside portion of the lever.

5. The tool of claim 1 is a push type strap tensioning tool further comprising a breaker nose pivotally coupled to the foot, the breaker nose having a strap engagement portion and a nose recess, the foot having a foot recess, a compression nose spring having a first end portion disposed in the nose recess and a second end portion disposed in the foot recess.

6. The tool of claim 5, the foot comprises a bracket extending upwardly from an inner portion of the strap support portion, the bracket is pivotally coupled to the gear housing, the second end portion of the compression foot spring is engaged with a substantially enclosed portion of the bracket on an upper portion of the tool so that the compression foot spring is not exposed on an upper portion of the tool, a nose pivot member pivotally couples the breaker nose to the bracket, the foot recess is on the bracket, and the compression nose spring is entirely enclosed between the foot recess and the nose recess, the compression nose spring pivotally biases the breaker nose so that the strap engagement portion thereof is positioned toward the strap support portion of the foot.

7. The tool of claim 5, the breaker nose having a strap engagement portion biased toward the strap support portion of the foot, a spacer member disposed between the breaker nose and the strap support portion of the foot to provide a gap between the strap engagement portion of the breaker nose and the strap support portion of the foot.

8. The tool of claim 1 further comprising, a handle having a first end portion coupled to the foot, the handle having an intermediate portion and a second end portion extending from the foot generally along the axial dimension of the gear housing, the handle is actuatable toward and away from the gear housing to pivot the foot against the pivotal bias of the compression foot spring.

9. A strap tensioning tool comprising:

a gear housing having a feed wheel protruding from a portion thereof;

a foot having a strap support portion disposed generally opposite the feed wheel, the foot having a bracket extending upwardly from an inner portion of the strap support portion;

a side plate coupled to the gear housing, the bracket of the foot disposed between the gear housing and the side plate;

a foot pivot member disposed through an opening of the bracket and pivotally coupling the foot to the gear housing, the foot pivot member having a first end portion rotatably supported by the gear housing, and the foot pivot member having a second end portion rotatably supported by the side plate.

10. The tool of claim 9, the gear housing having a first pivot recess and the side plate having a first pivot recess, the first end portion of the foot pivot member disposed in the first pivot recess of the gear housing, and the second end portion of the foot pivot member disposed in the first pivot recess of the side plate, the foot pivot member retained axially between the gear housing and the side plate.

11. The tool of claim 9 is a push type strap tensioning tool further comprising:

a roller, and a roller pivot member disposed through an opening of the roller, the strap support portion of the foot having first and second roller pivot recesses, the roller pivot member having a first end portion rotatably disposed in the first roller pivot recess, and the roller pivot member having a second end portion rotatably disposed in the second roller pivot recess, the roller pivot member retained axially between the foot and the gear housing, the roller pivot member rotatably supporting the roller on the foot.

12. The tool of claim 9 is a push type strap tensioning tool further comprising:

a breaker nose having a strap engagement portion;

a nose pivot member disposed through an opening of the breaker nose;

the bracket having first and second nose pivot recesses, the nose pivot member having a first end portion rotatably disposed in the first nose pivot recess, and the nose pivot member having a second end portion rotatably disposed in the second nose pivot recess, the nose pivot member retained axially between the gear housing and the side plate, the nose pivot member pivotally supporting the breaker nose on the foot.

13. A push type strap tensioning tool comprising:

a gear housing having a feed wheel protruding from a portion thereof, the gear housing having a housing recess;

a breaker foot pivotally coupled to the gear housing, the breaker foot having a strap support portion disposed generally opposite the feed wheel;

a breaker nose pivotally coupled to the breaker foot, the breaker nose having a strap engagement portion biased toward the strap support portion of the breaker foot, a spacer member disposed between the breaker nose and the strap support portion of the breaker foot to provide a gap between the strap engagement portion of the breaker nose and the strap support portion of the breaker foot, whereby a strap is insertable into the gap to move the breaker nose away from the strap support portion of the breaker foot.

14. The tool of claim 13, the spacer member is a protuberance extending from the breaker nose, the protuberance is biased into engagement with the strap support portion of the breaker foot.

15. The tool of claim 14, the strap engagement portion of the breaker nose extends at least partially across the strap support portion of the breaker foot between inner and outer portions of the breaker nose, the protuberance extending from the inner portion of the breaker nose.

16. The tool of claim 15, the gap between the strap engagement portion of the breaker nose and the strap support portion of the breaker foot having a tapered strap lead-in portion decreasing from the outer portion of the breaker foot toward the inner portion of the breaker foot.

17. A push type strap tensioning tool comprising:

a gear housing having a single access opening on a portion thereof, and a feed wheel coupled to a drive shaft protruding from the access opening;

a cover plate covering the access opening, the cover plate having a drive shaft opening through which the drive shaft protrudes;

a foot adjacent the cover plate, the foot having a strap support portion disposed generally opposite the feed wheel; and a side plate fastened to the gear housing, the foot pivotally coupled to the gear housing and the side plate between the cover plate and the side plate.

18. The tool of claim 17 further comprising a worm wheel disposed in the gear housing and coupled to the drive shaft extending therefrom, a first bearing disposed in and supported by the gear housing on an inner side of the worm wheel for rotatably supporting a first portion of the drive shaft, and a second bearing disposed in the gear housing and supported by the cover plate on an outer side of the worm wheel for rotatably supporting a second end portion of the drive shaft.

19. The tool of claim 18, the first bearing is a combined radial and thrust load bearing with a first diameter, and the second bearing is a radial load bearing with a second diameter smaller than the first diameter of the first bearing.

* * * * *